US009340843B2

(12) United States Patent
Jackson

(10) Patent No.: US 9,340,843 B2
(45) Date of Patent: May 17, 2016

(54) WIRE FOR REFINING MOLTEN METAL AND ASSOCIATED METHOD OF MANUFACTURE

(71) Applicant: Injection Alloys Limited, Hertfordshire (GB)

(72) Inventor: Chris Jackson, Hertfordshire (GB)

(73) Assignee: INJECTION ALLOYS LIMITED, Hertfordshire (GB)

( * ) Notice: Subject to any disclaimer, the term of this patent is extended or adjusted under 35 U.S.C. 154(b) by 242 days.

(21) Appl. No.: 13/950,341

(22) Filed: Jul. 25, 2013

(65) Prior Publication Data

US 2014/0130638 A1 May 15, 2014

(30) Foreign Application Priority Data

Nov. 9, 2012 (IN) ..... 3491/DEL/2012

(51) Int. Cl.
*C21C 7/00* (2006.01)
*C22B 9/10* (2006.01)

(52) U.S. Cl.
CPC ..... *C21C 7/0056* (2013.01); *C22B 9/10* (2013.01); *C22B 9/103* (2013.01)

(58) Field of Classification Search
CPC ..... C22B 9/10; C22B 9/103; C21C 7/0056
See application file for complete search history.

(56) References Cited

U.S. PATENT DOCUMENTS 2,085,802 A * 7/1937 Hardy ..... 75/304
4,308,056 A 12/1981 Guarino et al.
4,364,770 A * 12/1982 Douchy et al. ..... 75/304
5,087,290 A 2/1992 Wolfsgruber et al.
2009/0293674 A1* 12/2009 Stekly ..... 75/304

FOREIGN PATENT DOCUMENTS

CN 202482351 U * 10/2012
CN 202744584 U * 2/2013
DE 19916234 A1 * 9/2000 ..... C21C 7/00

OTHER PUBLICATIONS

Flesch, R. M. Patent DE 19916234 A1 published Sep. 2000. Machine translation.*
Shao, F. Patent CN 202482351 U published Oct. 2010. Machine translation.*
Wang, Z. Patent CN 202744584 U published Feb. 2013. Machine translation.*

* cited by examiner

*Primary Examiner* — George Wyszomierski
*Assistant Examiner* — Tima M McGuthry Banks
(74) *Attorney, Agent, or Firm* — Curatolo Sidoti Co., LPA; Salvatore A. Sidoti; Joseph G. Curatolo

(57) ABSTRACT

A molten metal refining wire is disclosed which comprises a metal sheath encapsulating a core of refining material, wherein the core is sealed within the sheath in a fluid-tight manner and wherein the thickness of the sheath is greater than about 0.6 mm. The core refining material apparent density ratio is at least about 95% of the theoretical solid core equivalent. The core refining material comprises calcium metal and silicon metal. A method of manufacturing a molten refining wire is also disclosed.

19 Claims, 2 Drawing Sheets

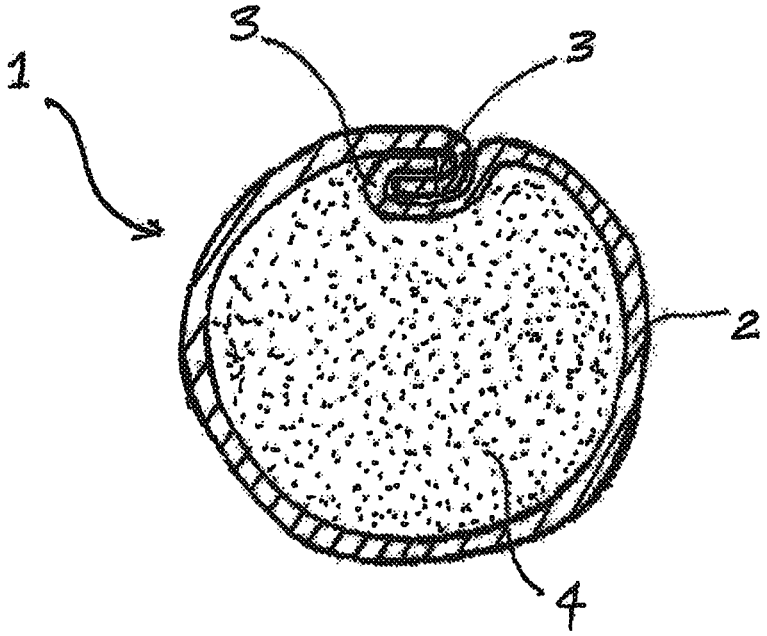
FIG. 1 – PRIOR ART
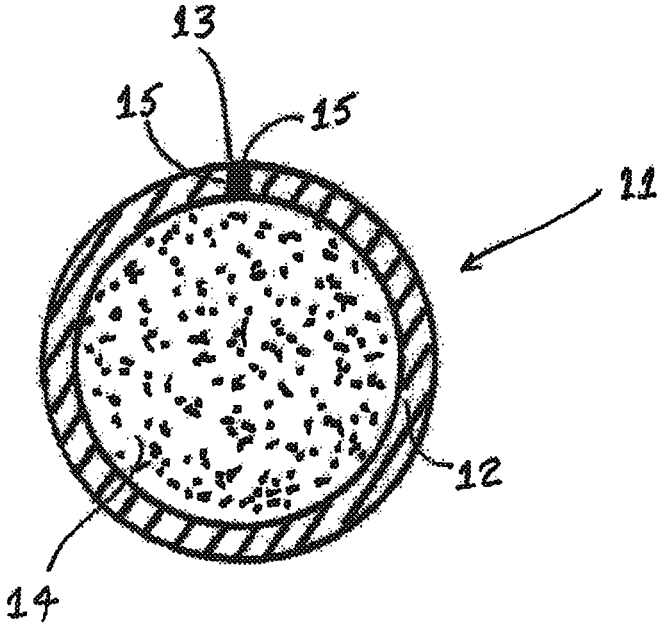
FIGURE 2

WIRE FOR REFINING MOLTEN METAL AND ASSOCIATED METHOD OF MANUFACTURE

CROSS REFERENCE TO RELATED APPLICATIONS

This application claims priority to Indian Patent Application No. 3491/DEL/2012 filed Nov. 9, 2012.

This invention relates to wire for refining molten metal with additives, such as metallic material and an associated method of manufacturing such wire.

Prior to casting a molten metal, such as molten steel, refining wires can be injected into the molten metal vessels such as ladle, pot or continuous casting tundish, to provide the metal with improved characteristics, for instance reduced levels of sulphur. Moreover, certain additives are known to function as inclusion modifiers to improve the mechanical properties and/or corrosion resistance of the metal.

The purpose of the refining wire is to inject refining materials, such as metals, encapsulated in the sheath of the wire into the molten metal in accurate quantities and in a controlled manner, when the refining materials display either a high affinity to oxygen, or a low melting and/or vapour point, or a high vapour pressure, or a low solubility or low density compared to the molten metal, or a combination of these factors. In this regard, it is important to achieve a high percentage of recovery (or yield) of the refining material defined as the ratio of the injected material quantity remaining into the molten metal divided by the total material quantity injected. In other words, the higher the percentage yield the better the characteristics and/or properties of the metal.

In a known method of manufacturing a refining wire, a steel strip is rolled to form a U-shaped section that is filled with refining material in powdered form.

The two longitudinal edges of the U-shaped strip section, which have been pre-folded to that effect, are then hooked together. In this manner, a refining wire is formed with a steel sheath encapsulating a core of refining wire.

Refining wires produced by these known methods usually have a sheath thickness in the range of 0.2 mm to 0.6 mm due to manufacturing and product constraints. As a result, the wire can be deformed easily by the high pressure of the feeder pinch rolls used to inject the wire through a guide tube into the molten metal vessel, thereby requiring guide tubes with comparatively large inner diameters which are detrimental to guiding the refining wire accurately into the vessel.

Sometimes also, the refining wire is not sufficiently rigid to penetrate a solidified surface of slag floating on the surface of molten metal, such as molten steel, in the vessel.

Further, the hook-type closure for the steel sheath of the wires discussed above does not allow for the deep rolling or drawing of such wires down to much smaller diameters, in which case, the core can include excessive and undesirable amounts of air which, during the refining process, is detrimental to the quality of the molten metal as well as the recovery of the core material. Moreover, the refining material can interact with components of the air or other materials, such as moisture or oxidizing agents, thus reducing the shelf life of the wire.

Some of these disadvantages result in part from the fact that the steel sheath of the refining wire is too thin, and secondly, from the encapsulated refining material not being sealed into the sheath in a fluid-tight manner.

Refining wires produced by these known methods generally contain refining material in the form of an alloy, such as calcium-silicon alloy, a ferro-titanium alloy, a ferro-boron alloy or any combination thereof.

Such alloys are typically manufactured by reacting metal oxide starting materials. For instance, a fusion reaction using calcium oxide and silicon oxide as starting materials results in the formation of calcium-silicon alloy ($CaSi_2$). The resultant alloy is then processed into powdered form for use in a refining wire.

Alloys of this kind typically contain 5 to 15% impurities which are detrimental to refining molten metal. For instance, calcium-silicon alloy is known to contain significant levels of elements such as iron, aluminium, carbon and the like. Accordingly, refining wires containing refining materials in the form of alloys display relatively low yields.

A further problem arises in that the ratio of calcium to silicon in such alloys is fixed. This is undesirable because the metal industry requires for there to be flexibility in the ratio of active ingredients present in the wire depending on the type of metal being refined or its purpose.

It is an object of the present invention to provide a refining wire that overcomes, or at least substantially reduces, the disadvantages associated with the known refining wires discussed above.

It is a further object of the invention to provide a refining wire having high yields, resulting in improved manufacturing techniques for refining molten metals, particularly molten steel.

It is a yet further object of the invention to provide a refining wire in which the ratio of active ingredients may be varied.

Accordingly, a first aspect of the invention provides a molten metal refining wire comprising a metal sheath encapsulating a core of refining material, wherein the core is sealed within the sheath in a fluid-tight manner, wherein the thickness of the sheath is greater than 0.6 mm, the core refining material apparent density ratio is over or around 95% of the theoretical solid core equivalent and the core refining material comprises calcium metal and silicon metal.

Preferably, the core refining material comprises about 25 to about 35% w/w calcium metal and about 65 to about 75% w/w silicon metal.

Preferably, the core refining material comprises about 26 to 34% w/w calcium metal, such as 27 to 33% w/w calcium metal, such as 28 to 32% w/w calcium metal, say 29 to 31% w/w calcium metal, with the remainder of the core refining material consisting of the silicon metal.

The inventors have discovered that a composition having calcium metal within these ranges results in improved calcium yield and/or improved inclusion modification of the molten metal.

Preferably, the core refining material is of a powdered or a granulate form.

Preferably, the wire has been deep rolled or drawn to a smaller diameter.

The sheath may be made of any suitable metallic material. However, when the refining wire is used for refining molten steel, the sheath is preferably a low carbon, low silicon steel.

Preferably, the core refining material consists essentially of the calcium metal and the silicon metal. In such embodiments, the core refining material contains substantially no impurities detrimental to refining molten metal.

As used herein, the term "substantially no impurities detrimental to refining molten metal" is intended to mean that the core refining material contains less than 1% w/w impurities, such as less than 0.9, 0.8, 0.7, 0.6, 0.5, 0.4, 0.3, 0.2% w/w impurities, e.g. less than 0.1% w/w impurities.

Preferably, the wire has a diameter of about 6 to about 20 mm.

Preferably, the core refining material comprises a central core, e.g. the calcium metal, encapsulated within an outer, e.g. the silicon metal.

The inventors have surprisingly discovered that by arranging the core refining material in this way the silicon metal reacts first with oxygen present in the molten metal at the point at which the metallic sheath melts. Accordingly, this results in a far superior calcium yield because the calcium metal is provided solely for inclusion modification due to low oxygen levels in the melt.

In some embodiments, the core refining material comprises a homogenous mix of the calcium metal and the silicon metal.

A second aspect of the invention resides in a method of manufacturing a molten metal refining wire comprising forming a metallic sheath into a generally U-shape; introducing into the metallic sheath a refining material comprising calcium metal and silicon metal; forming the metallic sheath so as to encapsulate the refining material into a core with longitudinal edges of the metallic sheath abutting each other; and sealing the longitudinal edges of the metallic sheath so as to seal the core within the metallic sheath in a fluid-tight manner.

Preferably, the method comprises the step of reducing a diameter of the metallic sheath by one or more of a deep rolling or a drawing down process so as to increase the apparent density ratio of the refining material in the core to over or around 95% of the theoretical solid equivalent.

Preferably, the method may comprise the step of arranging the core refining material within the metallic sheath such that the core refining material comprises a central core, e.g. the calcium metal, encapsulated within an outer, e.g. the silicon metal.

In some embodiments, the method may comprise the step of introducing into the metallic sheath a homogenous mix of calcium metal and silicon metal.

In any aspect of the inventive method defined above, the sheath may again be made of any suitable metallic material but when the refining wire is used for refining molten steel, the sheath is preferably a low carbon, low silicon steel.

The core of refining material may, again, comprise about 25 to about 35% w/w calcium metal, such as about 26 to 34% w/w calcium metal, such as 27 to 33% w/w calcium metal, such as 28 to 32% w/w calcium metal, say 29 to 31% w/w calcium metal, with the remainder of the core of refining material consisting of the silicon metal.

Thus, because the refining material consists of discrete calcium metal and discrete silicon metal, it is possible to vary the ratio of calcium metal to silicon metal in accordance with the intended purpose of the refining wire, as opposed to the fixed ratio of calcium to silicon present in the alloys of the previously known refining wires.

The edges of the sheath are preferably butt welded together.

Thus, because the refining wire sheath is sealed, such as welded, preferably butt welded, to encapsulate the refining material of the core in a fluid-tight manner, sheath thicknesses of up to 2.0 mm can be achieved, as opposed to a maximum sheath thickness of 0.6 mm for the previously known refining wires.

In order to reduce oxygen, air or other deleterious gases remaining in the sheath of the so-formed wire, the wire can be deep rolled or drawn to a smaller diameter, thereby expelling such gases from the wire, without detriment to the integrity thereof, whilst also tending to close the sheath around the core more tightly. In this manner, core refining material apparent density ratios over or around 95% of the theoretical solid core equivalent, can be achieved.

Further and due to the thicker sheaths, damage to the wire, which might otherwise occur with the known refining wires through the high-pressure of the pinch rolls thrusting the wire through the guide tubes into the molten metal vessel, is diminished, whilst the wire, particularly when having higher sheath thicknesses, is sufficiently rigid to penetrate the solidified surface of the slag floating on the surface of the molten metal in the vessel.

Further, the wire does not tend to melt high in the vessels before reaching the bottom thereof, as do the known refining wires, thereby releasing the refining material under high static pressure, far away from the oxygen present in the slag and atmosphere above, and increasing the floatation time of low density refining materials, these all being favourable factors for achieving a high recovery.

A third aspect of the invention provides a method of refining molten metal, comprising injecting into molten metal a refining wire in accordance with the first aspect of the invention or a wire manufactured in accordance with the second aspect of the invention defined above.

In order that the invention may be more fully understood, a refining wire in accordance therewith will now be described by way of example and by way of comparison with a prior art refining wire, in accordance with the accompanying Examples and drawings in which:

FIG. 1 is a cross-section of a known wire for refining molten steel;

FIG. 2 is a section of a wire for refining molten steel, in accordance with the invention.

Figure 3:
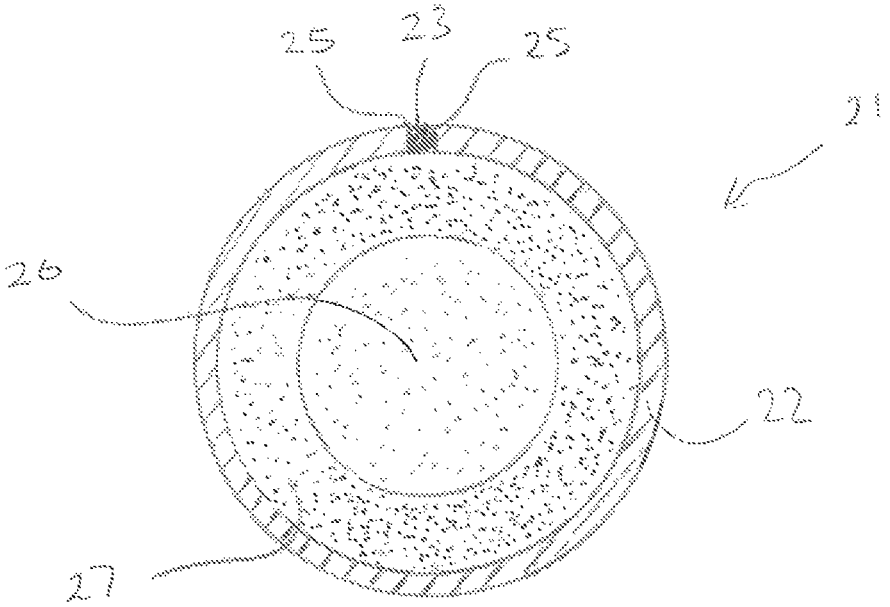
FIG. 3 is a section of a wire for refining molten steel, in accordance with the invention.

Referring firstly to the prior art refining wire, as indicated generally at 1 in FIG. 1, there comprises a steel sheath 2 which has been formed from a steel strip whose longitudinal edges have each been bent into the form of a hook 3. The steel strip will have also been bent into a U-shape for receiving therein a powdered refining material 4 in the form of an alloy. The two pre-folded edges 3 are then hooked together, so that the refining material 4 is encapsulated within the sheath 2 as a core.

As discussed above, due to the bulkiness of the hook-type closure and because that closure is not properly sealed, that is to say, it is not fluid-tight, deep rolling or drawing of the wire 2 is not possible and, also, air can be present within the refining material 4. This undesirable oxygen is detrimental to the quality of the molten steel as the refining wire 1 is injected hereinto, as well as to the recovery of the core material 4.

Referring now to FIG. 2 of the accompanying drawings, here is shown a molten metal refining, dosing wire 11 in accordance with the invention, wherein the steel sheath 12 has been formed from a strip of steel formed into a generally U-shape into which the refining material of the core has been provided.

In contrast to the prior art refining wire 1 discussed above in relation to FIG. 1, the confronting or abutting longitudinal edges 15 of the sheath 12 are sealed together in a fluid type manner by welding. Thus, this so-formed welded seam 13 encapsulates the core 14 of the wire 11 within the sheath 12 in a sealed, fluid-tight manner, thus preventing any undesirable oxygen or other gas or material from entering the interior of the sheath 12 during a molten metal refining process.

Also, any air, oxygen or other gas present in the sheath 12 can be reduced by expelling it from the sheath interior if the wire 11 is deep rolled or drawn down in diameter. This also tends to close the sheath 12 more tightly around the core 14.

FIG. 3 shows a refining wire 21 similar to the refining wire 11 of FIG. 2 in that the confronting or abutting longitudinal edges 25 of the sheath 22 are sealed together to form a seam 23. However, in this embodiment the refining material is arranged such that there comprises a central core 26 of the calcium metal encapsulated within an outer 27 of the silicon metal. Thus, when the sheath 22 of the refining wire 21 melts the outer 27 material is injected first into the molten metal before the central core 26 material.

The following Examples are provided to illustrate the composition and dimensions of preferred molten steel refining wires in accordance with the invention, wherein the steel from which the sheath is made is SAE 1006 steel or its equivalent, the core material is a mixture of powdered calcium metal and powdered silicon metal.

EXAMPLES

| Example | Wire Diameter | Sheath Thickness | Core Material | Weight of Core Material/Meter of Wire | Apparent Density Compared to Solid Calcium Core Equivalent |
|---|---|---|---|---|---|
| 1 | 15.4 mm | 1.0 mm | Ca: 29-31% Si: 68-70% | 235 grms/meter | 95% |
| 2 | 15.4 mm | 1.5 mm | Ca: 29-31% Si: 68-70% | 200 grms/meter | 95% |

Deep rolling or drawing of the wires may be necessary to provide smaller diameter wires, in dependence upon operating conditions of the refining process, whilst also tending to close the sheaths more tightly around the wire cores.

Thus, it can be seen that the invention provides refining wires which improve metal refining techniques, in that, inter alia, they reduce impurities being injected into molten metals, whilst retaining their overall integrity, particularly during their being fed to the molten metal vessel and their penetration into the molten metal through the slag floating on the molten metal surface.

Also because the sheaths are sealed and have regular, continuous, generally smooth circumferences, they can be readily deep rolled or drawn into smaller diameters without detriment to their integrity, whilst also expelling air, oxygen or any other undesirable gas from the sheath interiors.

Further, deep rolling or drawing of the refining wires to smaller diameters can provide for a core material keeping an apparent density or compression ratio of over 95% of the theoretical sold core equivalent.

In addition, because the calcium and silicon metals are incorporated in discrete form the resultant refining wire has very high levels of active ingredients (e.g. in excess of 99%) and/or comprises little or no contaminants detrimental to refining molten metal. Moreover, addition of calcium and silicon metals in discrete form means that the ratio of active ingredients can be tuned according to the intended process.

The invention claimed is:

1. A molten metal refining wire comprising a metal sheath encapsulating a core of refining material, wherein the core is sealed within the sheath in a fluid-tight manner, wherein the sheath has a thickness which is greater than 0.6 mm, the core refining material having an apparent density ratio of over or around 95% of the theoretical solid core equivalent and the core refining material comprises discrete calcium metal and discrete silicon metal and, wherein the core refining material comprises a homogenous mix of the calcium metal and the silicon metal.

2. The molten metal refining wire according to claim 1, wherein the wire has been deep rolled or drawn to a smaller diameter.

3. The molten metal refining wire according to claim 1, wherein the wire has a diameter of about 6 to about 20 mm.

4. A method of refining molten metal, comprising injecting into molten metal a refining wire in accordance with claim 1.

5. A molten metal refining wire comprising a metal sheath encapsulating a core of refining material, wherein the core is sealed within the sheath in a fluid-tight manner, wherein the sheath has a thickness which is greater than 0.6 mm, the core refining material having an apparent density ratio of over or around 95% of the theoretical solid core equivalent and the core refining material comprises discrete calcium metal and discrete silicon metal and, wherein the core refining material comprises about 25 to about 35% w/w calcium metal and about 65 to about 75% w/w silicon metal.

6. The molten metal refining wire according to claim 5, wherein the core refining material comprises about 26 to 34% w/w calcium metal, with the remainder of the core refining material consisting essentially of the silicon metal.

7. The molten metal refining wire according to claim 6, wherein the wire has a diameter of about 6 to about 20 mm.

8. The molten metal refining wire according to claim 6, wherein the wire has been deep rolled or drawn to a smaller diameter.

9. The method of refining molten metal, comprising injecting into molten metal a refining wire in accordance with claim 6.

10. A molten metal refining wire according to claim 6, wherein the core refining material comprises about 27 to 33% w/w calcium metal, with the remainder of the core refining material consisting essentially of the silicon metal.

11. A molten metal refining wire according to claim 10, wherein the core refining material comprises about 28 to 32% w/w calcium metal, with the remainder of the core refining material consisting essentially of the silicon metal.

12. A molten metal refining wire according to claim 11, wherein the core refining material comprises about 29 to 31% w/w calcium metal, with the remainder of the core refining material consisting essentially of the silicon metal.

13. The method of refining molten metal, comprising injecting into molten metal a refining wire in accordance with claim 5.

14. The molten metal refining wire according to claim 5, wherein the wire has been deep rolled or drawn to a smaller diameter.

15. The molten metal refining wire according to claim 5, wherein the wire has a diameter of about 6 to about 20 mm.

16. A molten metal refining wire comprising a metal sheath encapsulating a core of refining material, wherein the core is sealed within the sheath in a fluid-tight manner, wherein the sheath has a thickness which is greater than 0.6 mm, the core refining material having an apparent density ratio of over or around 95% of the theoretical solid core equivalent and the core refining material comprises discrete calcium metal and discrete silicon metal, wherein the discrete calcium metal and discrete silicon metal of the core refining material are both in a powdered or a granulate form.

17. The method of refining molten metal, comprising injecting into molten metal a refining wire in accordance with claim 16.

18. The molten metal refining wire according to claim 16, wherein the wire has been deep rolled or drawn to a smaller diameter.

19. The molten metal refining wire according to claim 16, wherein the wire has a diameter of about 6 to about 20 mm.

* * * * *